US005370558A

United States Patent [19]

Scherer et al.

[11] Patent Number: 5,370,558

[45] Date of Patent: Dec. 6, 1994

[54] WIRE RETAINER

[75] Inventors: Richard J. Scherer, Austin; Willard E. Anderson, Pflugerville, both of Tex.

[73] Assignee: Minnesota Mining and Manufacturing Company, St. Paul, Minn.

[21] Appl. No.: 161,912

[22] Filed: Dec. 3, 1993

[51] Int. Cl.[5] ..... H01R 9/22

[52] U.S. Cl. ..... 439/719; 439/459; 439/391

[58] Field of Search ..... 439/395, 401, 391, 456–459, 439/590, 719

[56] References Cited

U.S. PATENT DOCUMENTS 3,611,264 10/1991 Ellis, Jr. .
3,708,779 1/1973 Enright et al. .
3,713,214 1/1973 Enright et al. ..... 29/628
3,858,158 12/1974 Henn et al. .
3,945,705 3/1976 Seim et al. .
4,093,334 6/1978 Wickenberg et al. .
4,423,916 3/1984 Muehlausen, II .

FOREIGN PATENT DOCUMENTS 8405217 10/1984 Brazil .

OTHER PUBLICATIONS 3M printed procedure "Super Mate TM Module Replacement".

*Primary Examiner*—Khiem Nguyen
*Attorney, Agent, or Firm*—Gary L. Griswold; Walter N. Kirn; John C. Barnes

[57] ABSTRACT

A fixture for supporting a splicing module for telecommunications cables has a body member, generally the size of a comb, formed with a series of raised teeth, spaced its opposite edges, corresponding to the spacing of the contacts and wire receiving channels in the splicing module. The teeth are spaced and are formed to receive and locate the wires in relationship to a splicing module placed on the body member between the rows of teeth.

9 Claims, 2 Drawing Sheets

WIRE RETAINER

BACKGROUND OF THE INVENTION

1. Field of the Invention

This invention relates generally to the splicing of communication cables, and in particular relates to a wire retaining device, useful for positioning individual wires from a multi-stranded communication cable in separated predetermined position over a modular splicing connector base member. Such modular splice connectors are known in the art from U.S. Pat. No. 3,708,779 to D. J. Enright et al assigned to Minnesota Mining and Manufacturing Company.

2. Description of the Prior Art

Modular splice connectors are known in the art from U.S. Pat. No. 3,708,779 and 3,945,705 assigned to Minnesota Mining and Manufacturing Company. In the communication industry, multipair wire cables are spliced together for routing the cable pairs into a communication network. This is generally accomplished by the use of a wire splicing fixture as illustrated in U.S. Pat. No. 3,713,214. This is a fixture which requires considerable space to make the splices, is heavy and is set up at the splicing location and is generally adjustable to be positioned for splicing at the technicians comfort level. The fixture is provided to receive the base of a splice module and is provided with a wire retainer positioned at each side of the fixture to receive and hold the wires in a pre-terminating or pre-connectorizing position over the module base. Such space and comfort is not always available, and there are times when the splice has to be made in a location where there is not sufficient slack wire to permit the use of the splicing fixture if one had a fixture.

The present invention permits the supporting of a module base as described in U.S. Pat. No. 3,945,705, placing the wire pairs to be spliced in the fixture, and retained until the splice body is placed over the wire pairs and electrically joined to the contacts supported in the module body. The second set of wire pairs can then be inserted over the fixture of the present invention and joined electrically to the wire pairs first placed over the base to complete the splice when a cover is placed over the body forcing the individual wires of the second set of wire pairs into the contacts. This will complete the splice. The fixture could then be removed from the wires and module.

The fixture has as its purpose the support of the splicing module base in a fixed position on one surface, and retaining the wire pairs to be spliced in spaced paths transverse to the base to bridge the contact receiving apertures, allowing the body of the splicing module to be placed over and into electrical contact with the plurality of wires.

SUMMARY OF THE INVENTION

The present invention affords the means for supporting a base of a communications wire splicing module and providing wire supports on each of the two opposite longitudinal side edges for retaining wires in parallel spaced locations over the base or body of the module.

The fixture of the present invention has a body member, generally the size of a comb, formed with a series of raised teeth, spaced along each of its opposite edges, corresponding to the spacing of the contacts and wire receiving channels in the splicing module. Each tooth is formed in some manner with a head to permit a wire to be inserted between the teeth but restricted against displacement from between the teeth. A channel is formed between the edges of the body member and posts are formed at the ends of the channel to receive the ends of the base and retain it against longitudinal movement in relationship to the body member.

The fixture of the present invention comprises an elongate insulative body member adapted to receive a base element of a splice module and isolated wires from a multi-conductor cable. The member has an upper and lower surface and a first and second edge on the upper surface. A plurality of spaced teeth are formed along each edge and project from the upper surface, which teeth are spaced to guide and split wire pairs and receive a wire of each pair therebetween. The teeth are formed with heads on their free ends to restrict displacement of a wire positioned between the teeth. Projections or posts are formed on the upper surface and are positioned adjacent the ends of the body member. A rib extends lengthwise of the body member along the upper surface to define a channel for locating the base of a splicing module thereon with the ends thereof secured about the posts.

In operation, a base of a splicing module may be located on the upper surface of the body member, isolated individual wires of the communication cable are laid transversely across the body member and placed down between the teeth along the opposite side edges to lie in the wire receiving channels defined on the base of the splice module. A body of the module may then be placed over the base to engage the wires in electrical contact with the contact elements supported thereby.

The fixture may have extended ends to support, from the lower side, magnetic keepers to afford easy attachment of the fixture to cabinets, pedestals or building entrance terminals during splicing.

DESCRIPTION OF THE PREFERRED EMBODIMENT

Figure 1:
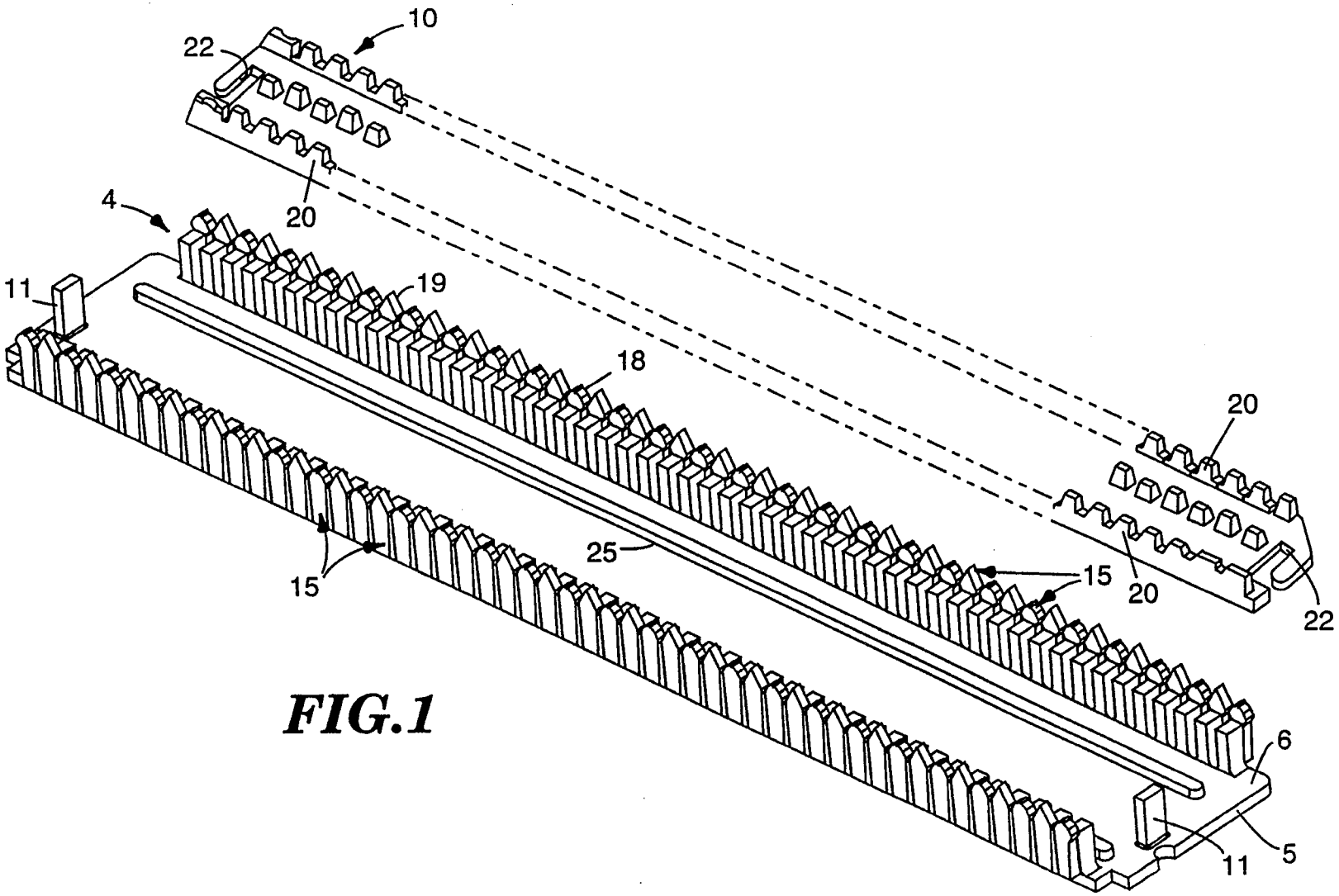
FIG. 1 is a perspective view of the fixture of the present invention with the base of a splicing module shown diagrammatically positioned over the fixture.

The fixture as shown and described is adapted to aid in the splicing of 25 pairs of wires from a communication cable. This number is a standard of the U.S. communication industry; however, it is clear that the device according to this invention can be adapted to other cable standards.

The fixture is generally designated 4 and comprises a retainer body member 5 having an elongated planar portion with an upper 6 and a lower 7 surface. The upper surface is formed with a channel, as hereinafter defined, to receive a splicing module base 10 which is aligned in this channel by registration alignment posts 11 on the body 5 which cooperate with openings in the ends of the base.

Figure 3:
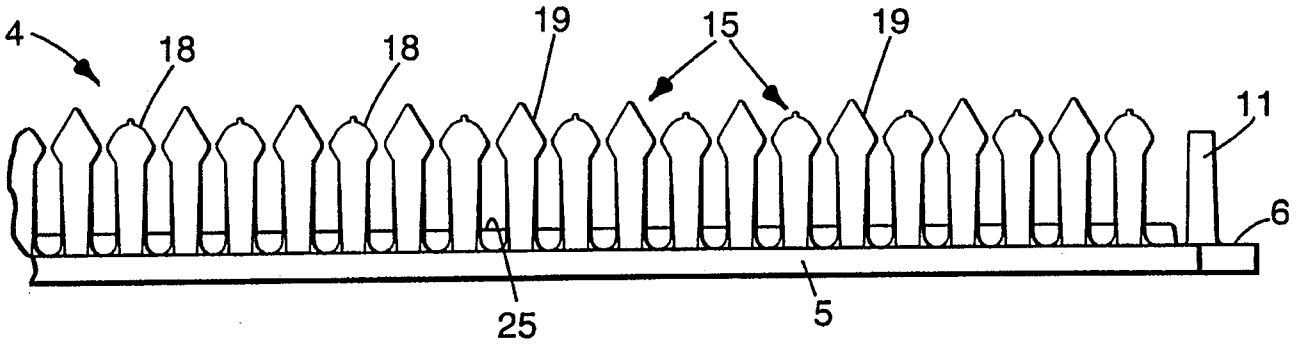
FIG. 3 is an enlarged fragmentary side view of the teeth for retaining the wires, positioned in spaced relationship along the edge of the body member.
Figure 4:
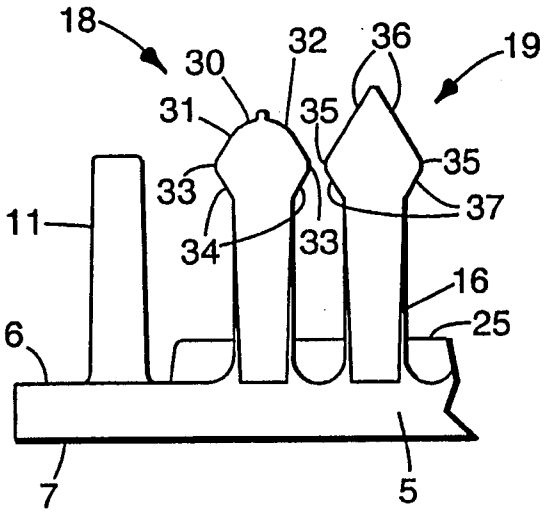
FIG. 4 is an enlarged detail view of the teeth.

The body member 5 is flexible and has a first and second edge on the upper surface 6. A plurality of spaced teeth 15 are formed in a row along each edge and the teeth project from the upper surface 6. The teeth are spaced to receive a wire therebetween. The standard wire gauge in the U.S. communications industry is between 22 and 28. The teeth 15 are formed with heads for restricting displacement of the wires inserted between the teeth 15. The teeth 15 are formed with alternating forms of heads as shown in FIGS. 3 and 4 to assist the separating and entry of the individual isolated wires into the space between the teeth. As illustrated the teeth have a first set of heads 18 with rounded or dome shaped ends, alternately positioned, between teeth 15 with heads 19, which heads 19 are formed with pointed ends which project above the level of the heads 18. The pointed ends aid in the separation of the wires of the wire pairs. The spacing of the teeth 15 corresponds with the spacing of separators 20 positioned along the side edges of the base 10, defining, together with center posts on the base, channels for the wires.

Figure 2:
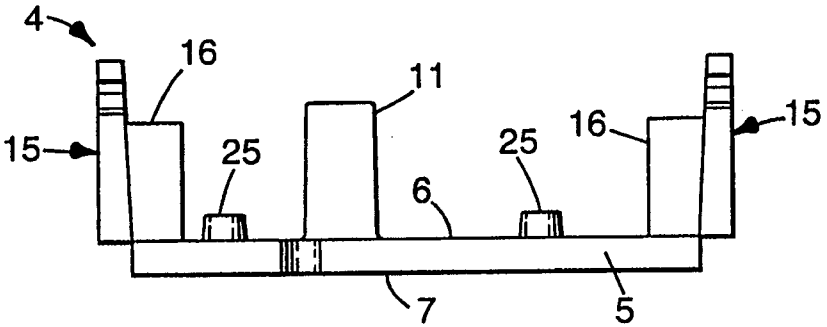
FIG. 2 is an end view of the fixture.

The shape of the heads on the teeth may have a variety of configurations which permit insertion and removal of the wires between the teeth without damaging the insulative coating on the wires, without departing from the spirit of the invention, but the heads illustrated are preferred. As shown in FIG. 4, the teeth 18 extend to a height of about 0.3 inch (7.6 mm) above the surface 6, with a rounded free end defined by a radiused upper surface 30, radius of 0.04 inch (1.0 mm), joined to planar sides 31 and 32 disposed at an angle of sixty (60) degrees with respect to each other. The sides 31 and 32 connect to a 0.010 inch (0.25 mm), generally vertically disposed surface 33, which surface 33 is spaced from an opposed surface 35 on the teeth 19 by 0.020 inch (0.5 mm). The surfaces 33 and 35 define the closest surfaces between the teeth 18 and 19. The surfaces 33 connect to converging edges 34 disposed at an angle of thirty (30) degrees to a line perpendicular to the surface 6. The teeth 19 terminate, 0.385 inch (9.8 mm) from the surface 7, with a radiused upper free end where side edges 36 converge, which side edges are disposed at an angle of sixty (60) degrees with respect to each other. The lower ends join surfaces 35, which in turn connect to surfaces 37, at a point 0.233 inch (5.9 mm) above the surface 6, and 0.293 inch (7.442 mm) above the surface 7, which surfaces 37 are disposed at an angle of thirty (30) degrees with a line perpendicular to the surface 6. The surfaces 31,32, 36 and 34,37, are disposed such that the wires of the cable can be inserted and removed with limited, if any, deleterious affect on the insulation surrounding the conductor of the wires. The opposed surfaces of gusset members 16, hereinafter described, are spaced 0.061 to 0.056 inch (1.55 to 1.42 mm) apart. The height of the teeth, between the heads and the upper surface of the body member is sufficient to receive at least a pair of wires, such that a first wire to be supported transverse to the base can be placed between the teeth 15, and later a second wire can be inserted which will be positioned transverse to the body of a splicing module as defined in U.S. Pat. No. 3,945,705, which patent is incorporated herein by reference. In some field operations, only one row of the teeth 15 will be used to locate the wires, and in others, the wires will be inserted between teeth on both sides of the fixture 4. The upper surface portions 36 of the heads 19 will be color coded generally to aid in the splicing operation according to conventional practice. Further, as illustrated in FIG. 2, the teeth 15 are fulcrumed from the actual edges of the body member and supported by gusset members 16 molded on the upper surface of the body member. The members 16 also serve to extend the channel or wire path adjacent the edges to straighten the path of the individual wires. The body member thus is formed with recessed side edges along the lower surface to permit its location on a stabilizing surface if necessary to restrict sidewise movement.

The posts 11 are formed on the upper surface 6 and are positioned asymmetrically adjacent the ends of a channel on the upper surface 6 of the body member 5. A rib, or as illustrated a pair of spaced ribs 25 forming opposed continuous surfaces, extend longitudinally of the body member 5 on the upper surface 6 to define the channel for receiving the base of the module. The spacing of the ribs 25 accommodates the base and the end openings 22 of the base 10 are positioned about the posts 11 to register the base and restrict lengthwise movement of the base 10 once it is placed in the channel. The spacing of the channel defined by the ribs 25 is 0.321 inch (8.1 mm) from the outside edge of the teeth on one edge of the base and 0.264 inch (6.7 mm) from the opposite edge. This spacing affords movement of the wires from a module body down to the position between the teeth 15.

The fixture 4 is preferably formed of a polymeric material having a flexural strength as measured by ASTM test method D790. of 13,500 PSI min. (93 MPa) and a Multi-Axial Impact rating of 352 in./lbs (40 NM) based on ASTM method D3763. A preferred material is a polycarbonate. Examples are Lexan 141R from General Electric of Pittsfield, Mass., Miles Makrolon 2805 from Miles, Inc. of Pittsburg, Pa. and Dow Calibre 301.10 from The Dow Chemical Company of Midland, Mich. The flexibility of the fixture 4 permits a bending or peeling of the body member 5 from the splicing module or base 10. This further reduced the resistance of the teeth to movement of the wires from between the teeth by increasing the spacing between the surfaces 33 and 35.

In operation, a base 10 of a splicing module may be located on the upper surface 6 of the body member 5, isolated individual wires of the communication cable are laid transversely across the body member 5 and placed down between the teeth 15 and gusset members 16 at the opposite side edges to lie in the wire receiving channels defined on the base 10 of the splice module. A body of the module may then be placed over the base 10 to engage the wires in electrical contact with the contact elements supported thereby.

The crimping action of the body to the base of the module can be simply made by the use of a pliers (not shown) or by the thumbs of the technician, if able, to secure the wires to the base and in electrical engagement with the insulation displacing contact portions of the electrical contacts supported in the body of the module. At that time a second set of wires may be placed over the body and forced between the heads of the teeth 15 to retain the wires in position until a cover is placed over the body forcing the wires into insulation displacement electrical connection with the other end of the contact elements.

Having described the present invention with reference to an illustrated embodiment, it is to be understood that the height of the teeth along one side, the height of the posts, the length of the body member, spacing of the teeth and shape of the heads can be varied without departing from the spirit and scope of the invention as defined in the appended claims.

We claim:

1. A device for separating and positioning individual wires of a multiple conductor cable in a fixed relationship over the base element of a splice connector comprising:

an elongate insulative body member adapted to receive a base element of a splice connector and isolated wires from a multiconductor cable, said body member having an upper and lower surface and a first and second edge on said upper surface, means defining a channel along the upper surface of said body member including opposed continuous surfaces extending longitudinally of the body member for receiving a said base element with posts at the ends to register the said base element, and a plurality of spaced teeth positioned along an least one edge of the body member, which teeth have heads affording insertion of wires between the teeth for location and restriction from displacement.

2. A device according to claim 1 wherein said means defining a channel comprises a pair of ribs extending in a lengthwise direction on the upper surface of the body member.

3. A device according to claim 1 wherein said posts are positioned adjacent the ends of the channel and asymmetrically with relationship to the edges of the body member to register the base on the body member.

4. A device according to claim 1 wherein the teeth are positioned along each edge of the body member and comprise spaced teeth having alternating configurations at the free ends to accommodate the insertion of wires therebetween and to restrict displacement of the wires from between the teeth.

5. A device according to claim 4 wherein said posts are positioned adjacent the ends of the channel and asymmetrically with relationship to the edges of the body member to register the base on the body member.

6. A device according to claim 5 wherein said means defining a channel comprises a pair of ribs extending in a lengthwise direction on the upper surface of the body member.

7. A device according to claim 4 wherein the alternate teeth are formed by teeth with rounded free ends spaced from teeth having pointed free ends, terminating above the rounded free ends, and spaced about 0.020 from each other at their closest surfaces.

8. A device according to claim 7 wherein the teeth have converging surfaces terminating at their closest surfaces and diverging surfaces leading into the spacing between the teeth and between the closest surfaces and the upper surface.

9. A device according to claim 1 wherein the body member and teeth are formed of a flexible polymeric material.

* * * * *